US005400975A

United States Patent [19]

Inculet et al.

[11] Patent Number: 5,400,975

[45] Date of Patent: Mar. 28, 1995

[54] ACTUATORS FOR ELECTROSTATICALLY CHARGED AEROSOL SPRAY SYSTEMS

[75] Inventors: Ion I. Inculet, London, Canada; David A. Tomkins; Mark E. Wefler, both of Racine, Wis.

[73] Assignee: S. C. Johnson & Son, Inc., Racine, Wis.

[21] Appl. No.: 145,547

[22] Filed: Nov. 4, 1993

[51] Int. Cl.[6] ..... B05B 5/043

[52] U.S. Cl. ..... 239/690.1; 239/708

[58] Field of Search ..... 239/690, 690.1, 708, 239/3; 222/402.13, 402.15; 361/225-228, 230; 310/339

[56] References Cited

U.S. PATENT DOCUMENTS

| | | | |
|---|---|---|---|
| 2,019,333 | 10/1935 | Auerbach | 361/231 |
| 2,884,166 | 4/1959 | Vosbikian et al. | 222/323 |
| 3,114,654 | 12/1963 | Nishiyama et al. | 118/627 |
| 3,198,170 | 8/1965 | Onishi | 118/627 |
| 3,263,127 | 7/1966 | Point et al. | 361/227 |
| 3,659,791 | 5/1972 | Clark | 239/375 |
| 3,734,357 | 5/1973 | Batistelli et al. | 222/323 |
| 3,738,574 | 6/1973 | Guntersdorfer et al. | 239/102.2 |
| 3,815,819 | 6/1974 | Hamlin | 239/11 |
| 3,819,963 | 6/1974 | Kondo et al. | 310/339 |
| 3,912,953 | 10/1975 | Edoardo | 310/339 |
| 4,004,733 | 1/1977 | Law | 239/3 |
| 4,098,436 | 7/1978 | Kohlbeck | 222/182 |
| 4,120,016 | 10/1978 | Hendricks | 361/228 |
| 4,248,386 | 2/1981 | Morle | 239/707 |
| 4,331,299 | 5/1982 | Culbertson et al. | 239/691 |
| 4,341,347 | 7/1982 | De Vittorio | 239/3 |
| 4,356,528 | 10/1982 | Coffee | 361/226 |
| 4,381,533 | 4/1983 | Coffee | 361/228 |
| 4,396,157 | 8/1983 | Inculet | 239/598 |
| 4,421,281 | 12/1983 | Coffee et al. | 239/690 |
| 4,476,515 | 10/1984 | Coffee | 361/226 |
| 4,489,894 | 12/1984 | Marchant et al. | 239/693 |
| 4,502,629 | 3/1985 | McGhee et al. | 239/3 |
| 4,509,694 | 4/1985 | Inculet | 239/697 |
| 4,544,570 | 10/1985 | Inculet | 427/475 |
| 4,560,107 | 12/1985 | Inculet | 239/3 |
| 4,561,037 | 12/1985 | MacLaine et al. | 361/228 |
| 4,579,258 | 4/1986 | Brown et al. | 222/323 |
| 4,586,657 | 5/1986 | Johnson et al. | 239/691 |
| 4,612,598 | 9/1986 | Norris | 361/227 |
| 4,659,012 | 4/1987 | Coffee | 239/3 |
| 4,664,315 | 5/1987 | Parmentar | 239/706 |
| 4,666,089 | 5/1987 | Inculet | 239/707 |
| 4,673,132 | 6/1987 | Inculet | 239/706 |
| 4,710,849 | 12/1987 | Norris | 361/228 |
| 4,726,521 | 2/1988 | Simm et al. | 239/3 |
| 4,805,812 | 2/1989 | Brody | 222/402.11 |
| 4,971,257 | 11/1990 | Birge | 239/708 |
| 5,115,971 | 5/1992 | Greenspan et al. | 239/3 |
| 5,121,884 | 6/1992 | Noakes | 239/691 |
| 5,156,880 | 10/1992 | Inculet | 427/483 |
| 5,229,171 | 7/1993 | Donovan et al. | 239/690 X |

*Primary Examiner*—Andres Kashnikow
*Assistant Examiner*—Lesley D. Morris

[57] ABSTRACT

An actuator for electrically charging an aerosol spray has an inductor located adjacent to the spray nozzle to induce a charge on the atomized fluid. Charge to the inductor is provided by a piezoelectric crystal which is stressed by movement of an operating member to open the spray valve. Inductor charging utilizes negligible electrical power so that additional power sources are not required. The crystal may be stressed continuously such as by squeezing, or intermittently, such as by striking. When an intermittent stressing is utilized, the electrical circuit includes a switch between the crystal and inductor which is opened as the valve is opened to isolate electrically the inductor during spraying.

36 Claims, 16 Drawing Sheets

FIG. 2
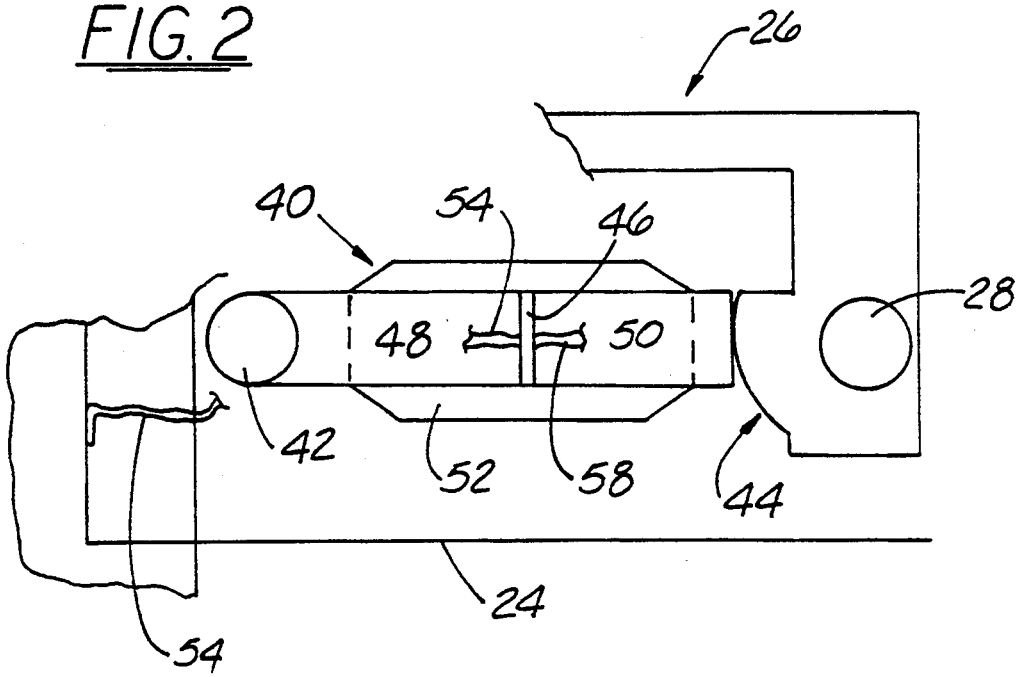
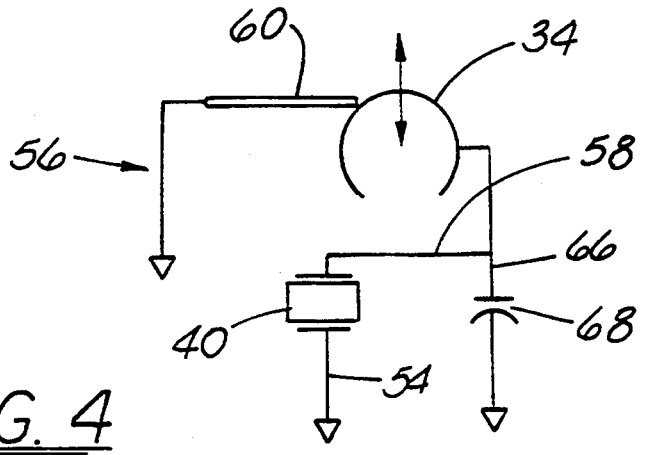
FIG. 4

ACTUATORS FOR ELECTROSTATICALLY CHARGED AEROSOL SPRAY SYSTEMS

The present invention relates to aerosol spray devices and in particular to an actuator to control the spraying of material from the aerosol.

The dispensing of material, typically a fluid, from a pressurised container is well known. The egress of the material from the container is controlled by a valve which is normally biased to a closed or sealed position. The material is typically dispensed through a nozzle to atomize the material and disperse it evenly over the target area. An actuator is used to open and close the valve and is typically formed with the container so that a self contained package is provided.

With some materials, for example air fresheners, it is desirable to broadcast the contents as widely as possible. With other materials however it is desirable to deliver the material in a controlled manner to ensure application to the specific area to be treated and/or to improve the efficiency at which the active ingredients are delivered by minimizing the amount of spray outside the target.

It is known that application of an aerosol spray may be enhanced by electrostatically charging the spray as it is dispensed from the nozzle. The spray acquires an electrostatic charge and is then attracted to an electrically grounded or oppositely charged body. There are several charging mechanisms that have been proposed to apply a charge to an atomised spray, among them corona discharge charge transfer and induction charging are the most common.

With corona discharge an electrode is positioned in the spray and electrons transferred from the electrode to the surrounding fluid. The electrode is maintained at a high potential by a power source connected to the electrode. An example of such a system is shown in U.S. Pat. No. 4,341,347 to De Vittoria where an electrode is placed in a fluid stream to improve the charge transfer to relatively low velocity, low particle size sprays. However, as noted in U.S. Pat. No. 4,489,894 to Marchant, corona discharge charge transfer is relatively inefficient as little of the discharge current is usefully applied.

Induction charging is a method which under well controlled conditions, requires only a negligible electrical power. The induction charging is well documented in the literature and is used extensively in agricultural spraying.

With induction charging, a potential is impressed on the electrode that establishes a local electrical field. As the fluid is being atomized, it is subjected to the field established by the electrode and a charge of opposite polarity is induced on the fluid. The atomized drops, once in the air, retain the charge which was induced at the tip of the liquid filaments whilst under the influence of the inducing electric field. An electron flow is established to or from "ground" through the fluid to replenish the electric charge removed with the spray. As such, induction charging, in broad terms, may be classified as using an "electrical potential" rather than "electric power". Such a system is described in U.S. Pat. No. 2,019,333 to Auerbach.

One difficulty encountered with induction charging is that the electrode attracts the atomized fluid and under certain aerodynamic conditions can be wetted by it. This may result in loss of electric power from the electrode. Whilst this problem may not be severe where the spraying is conducted in a carefully controlled environment, it is a greater problem, as noted by Law in U.S. Pat. No. 4,004,733, where widely varying environments may be encountered. Law suggests reducing the electrical potential on the inductor which also requires a reduction in the physical spacing between the nozzle and inductor. This increases the tendency for wetting of the inductor. Law proposes to keep the inductor dry by a gaseous air stream interposed between the inner surface of the annular electrode and the droplet forming region. In order to achieve this effect, however, a high air flow is required and a narrow spray pattern is produced. This may be feasible in the type of application contemplated by Law, namely agricultural spraying but is not practical for portable, self contained spray devices.

U.S. Pat. No. 4,664,315 to Parmentor seeks to broaden the spray pattern suggested by Law by introducing a swirl to the air flow and to reduce electrical charge leakage by increasing the electrical path length between the nozzle and ground. However, a high air flow is still required and the nozzle configuration to produce the swirl introduces complexity to the nozzle design that may increase the tendency for deposition of fluid.

There have been prior proposals to charge electrostatically the spray delivered by an aerosol dispenser of the type having a canister of fluid under pressure. Such dispensers are designed to be portable and self contained as well as economical to produce. One such prior proposal is shown in U.S. Pat. No. 4,971,257 to Birge. In this arrangement an aerosol container is supported in a frame having a pivotally mounted trigger to operate the aerosol valve. An electrode is positioned in the aerosol spray and transfers charge to the spray by corona discharge. A rechargeable battery is provided in the frame to deliver power through a high voltage transformer to the electrode as the trigger is operated. The use of a rechargeable power source is necessary due to the power demands of the charge mechanism but make the device uneconomical for disposable self contained aerosol containers.

A third approach to obtaining a charged spray of fluids is disclosed in U.S. Pat. No. 4,476,515 to Coffee and has been referred to as electrodynamic spraying. Rather than using a pressurized aerosol container, Coffee proposes to utilize electrostatic forces to atomize fluid flowing through a number of capillary tubes and apply a charge to it. An electric field is established at the exit from the tubes by applying a high voltage from a power source to the tubes. A grounded electrode surrounds and is spaced from the tubes to intensify the field at the exit. The field counteracts the effects of surface tension in the fluid and produces a highly atomized fluid flow. Electrical power is preferably supplied to the electrodes by a battery pack formed from a number of replaceable battery cells. This renders the device unsuitable for a self contained aerosol container. Moreover the charge mechanism contemplated in Coffee relies upon a discharge current as the charge is imparted to the fluid prior to atomization. Thus although Coffee contemplates the use of a piezoelectric crystal to supply the electrical power and thus eliminate the need for batteries the flow rates are limited by the electrical energy available. Moreover, the charge mechanism proposed by Coffee requires a specific formulation of fluid using organic liquid dilutents to achieve satisfactory results. Water based formulations, such as are used conventionally, do not, according to Coffee, produce satisfactory results with this mechanism.

A similar approach is contemplated in U.S. Pat. No. 5,115,971 to Greenspan where a nebulizer atomizes a product supplied from a reservoir. In this arrangement, the electrical potential is again derived from a piezoelectric crystal but a control circuit is utilized to even out the electrical power generated by the crystal and extend the period over which it can be applied to the electrode. Such a technique may be practical for the limited quantity of fluid received from a nebulizer but is not practical where a prolonged spray is required. Neither Greenspan nor Coffee contemplate a device for use with a container that delivers an atomised spray to impart a charge to atomized spray but rather suggest alternative approaches to obtaining an atomized spray.

There is therefore a need for a self-contained aerosol dispenser that dispenses an electrically charged spray and it is an object of the present invention to provide such a spray device that obviates or mitigates the above disadvantages.

In general terms, therefore, the present invention provides a dispenser in which an electrical charge is applied to an aerosol spray by induction charging and the electrical induction potential is derived from a piezoelectric crystal incorporated in the actuator for the dispenser.

More particularly, the present invention provides an actuator for use with an aerosol spray device having a pressurized container and a valve including a nozzle to dispense the contents of the container as an atomized spray. The actuator comprises a piezoelectric crystal assembly which is connected electrically to an inductor located adjacent to the nozzle. An operating member is movable from a first position in which the valve is closed to a second position to engage and open the valve. Movement of the operating member from the first position induces a stress in the crystal assembly and applies an electrical potential to the inductor. Fluid dispensed by the nozzle is thus charged by induction.

In a preferred embodiment, movement of the operator causes an intermittent stressing of short duration of the crystal assembly by application of a transient force or impact and the electrical connection between the inductor and crystal assembly includes a circuit element to maintain a charge in the inductor.

It is also preferred that continued movement of the operator to the second position electrically disconnects the inductor and crystal assembly.

As a further preference, the inductor and crystal assembly are electrically connected to a grounding strap when the operating member is in the first position.

By providing an actuator in which charge is induced on the fluid as it is dispensed, the potential requirements may be met with a piezoelectric crystal assembly without the need for external power sources.

Moreover, the induction charge transfer is effective with standard formulations, including water based emulsions so that further agency approvals or registrations are not required.

Embodiments of the invention will now be described by way of example only with reference to the accompanying drawings, in which FIG. 1 is a general schematic view of a dispenser and actuator;

FIG. 2 is a view on an enlarged scale of a portion of the actuator shown in FIG. 1;

FIG. 4 is a circuit diagram of the electrical components used on the actuator shown in FIG. 1;

Figure 9:
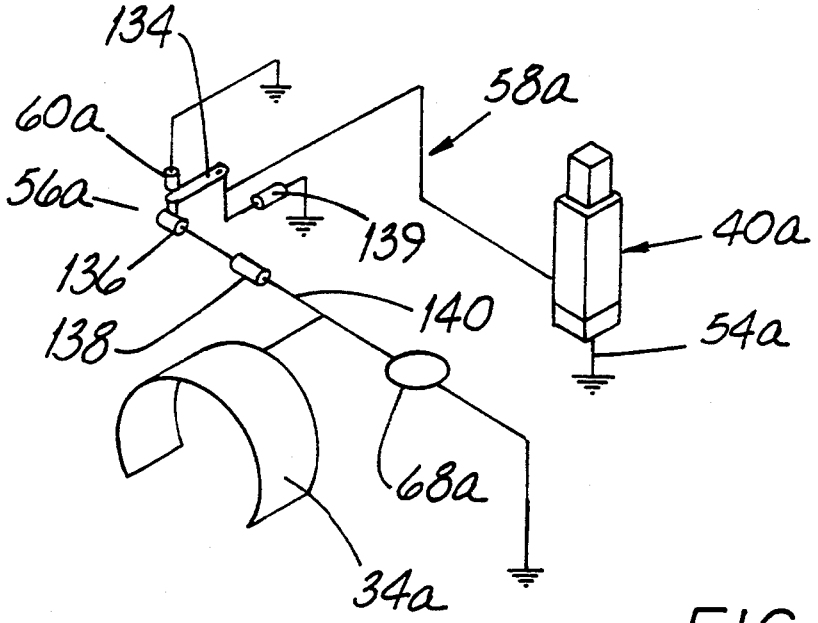
FIG. 9 is a perspective line drawing of the components used in the electrical circuit of the embodiment of FIGS. 5 to 8.
Figure 10A:
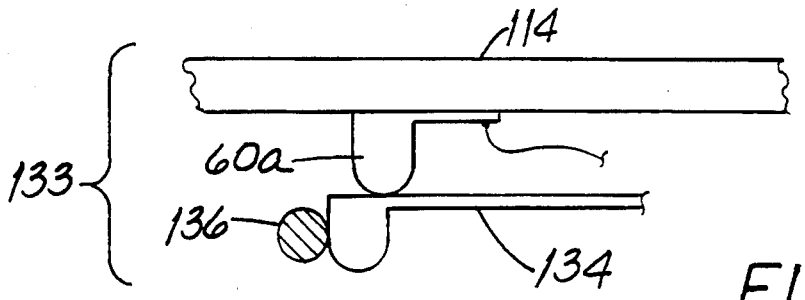
Figure 10B:
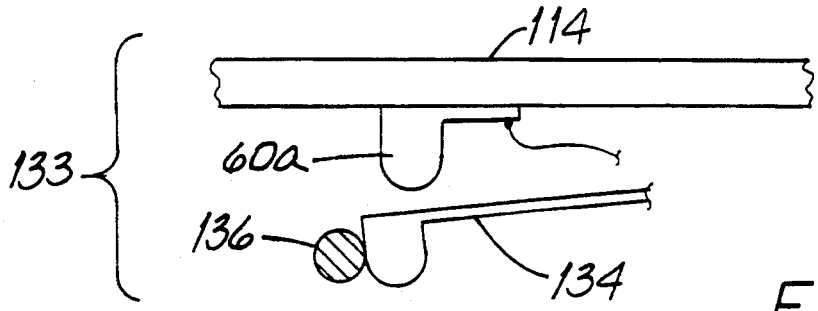
Figure 10C:
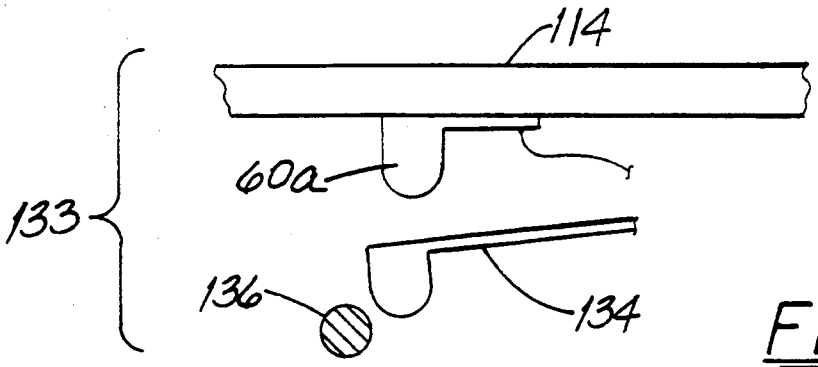
Figure 11:
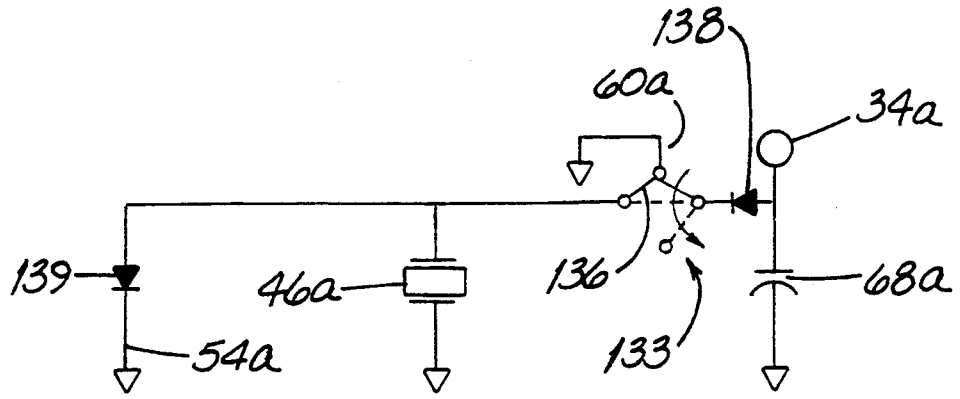
Figure 12:
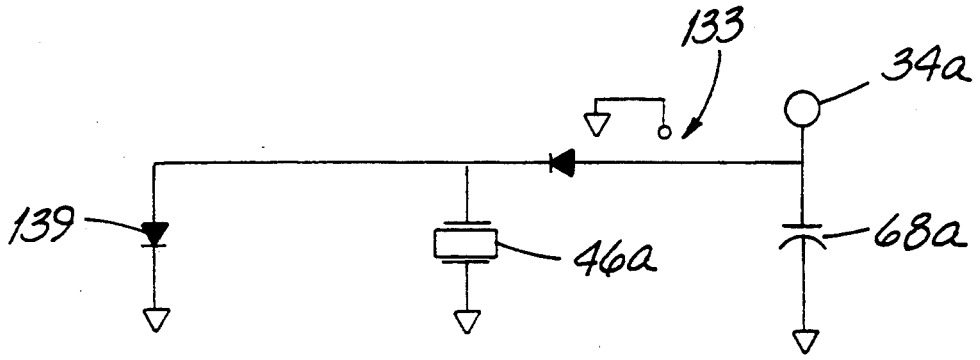
Figure 13:
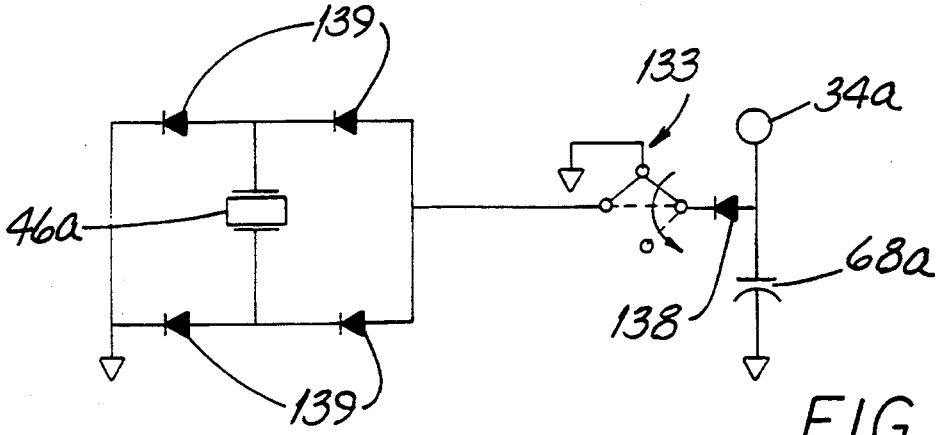
Figure 14:
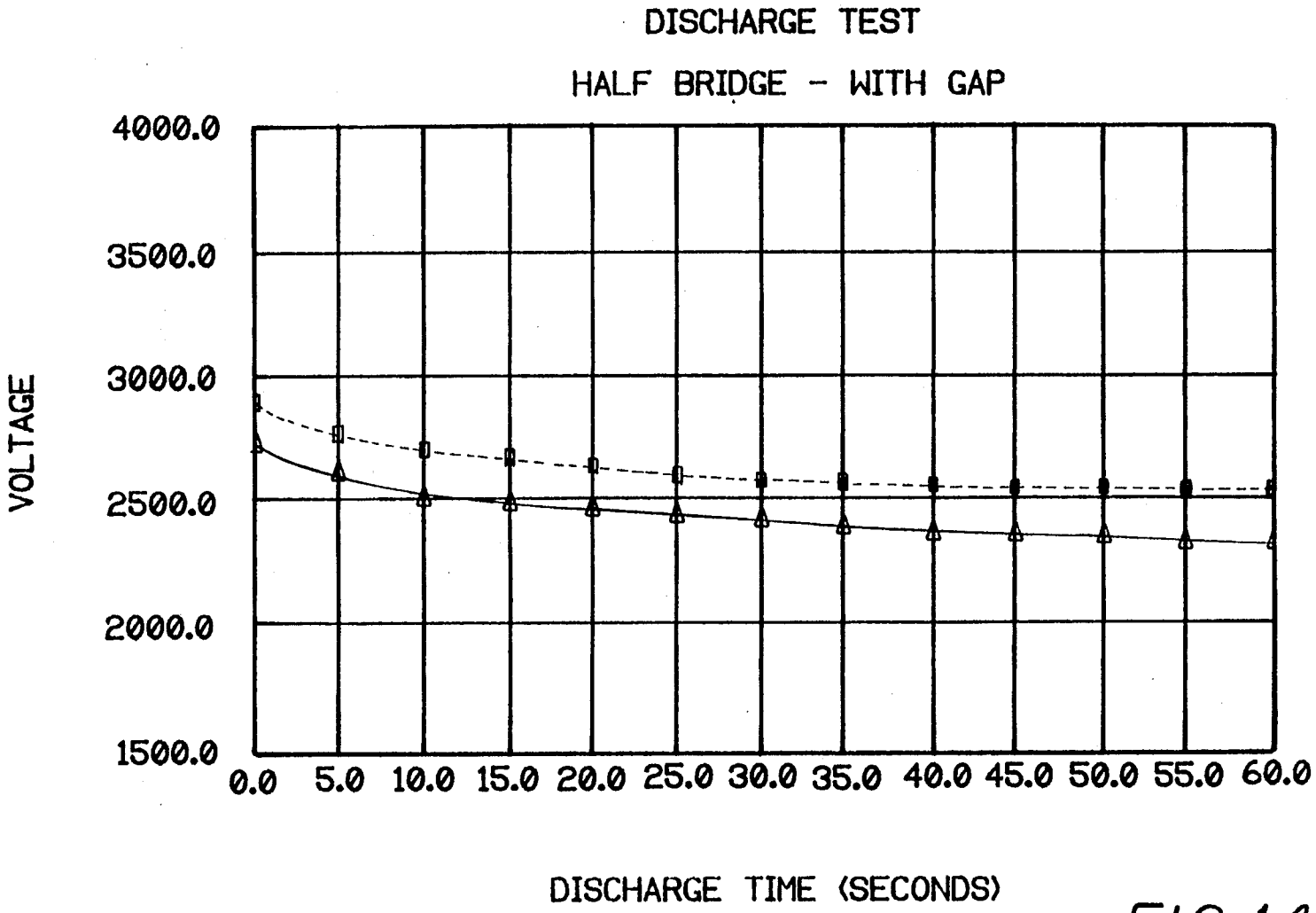
Figure 15:
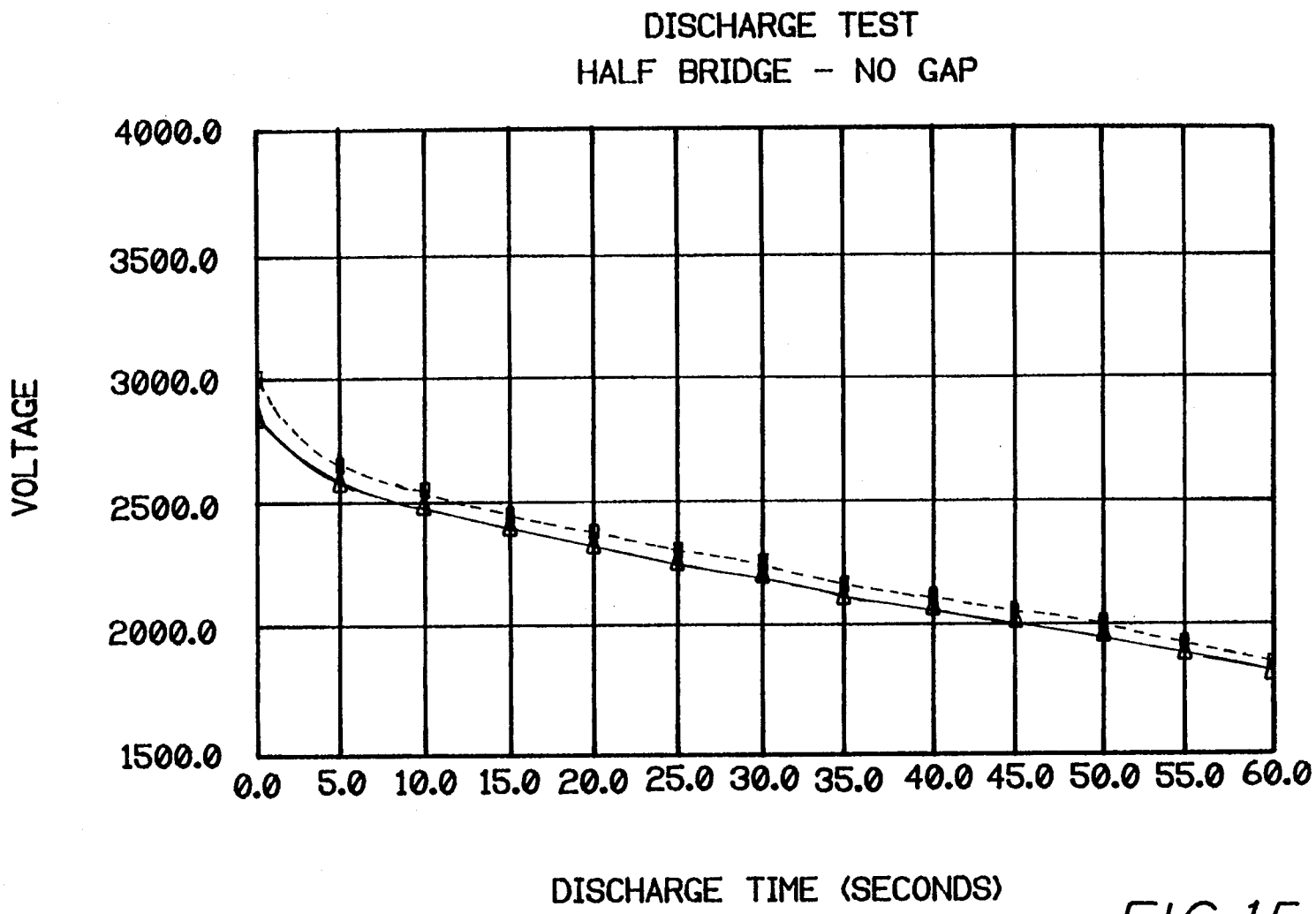
Figure 16:
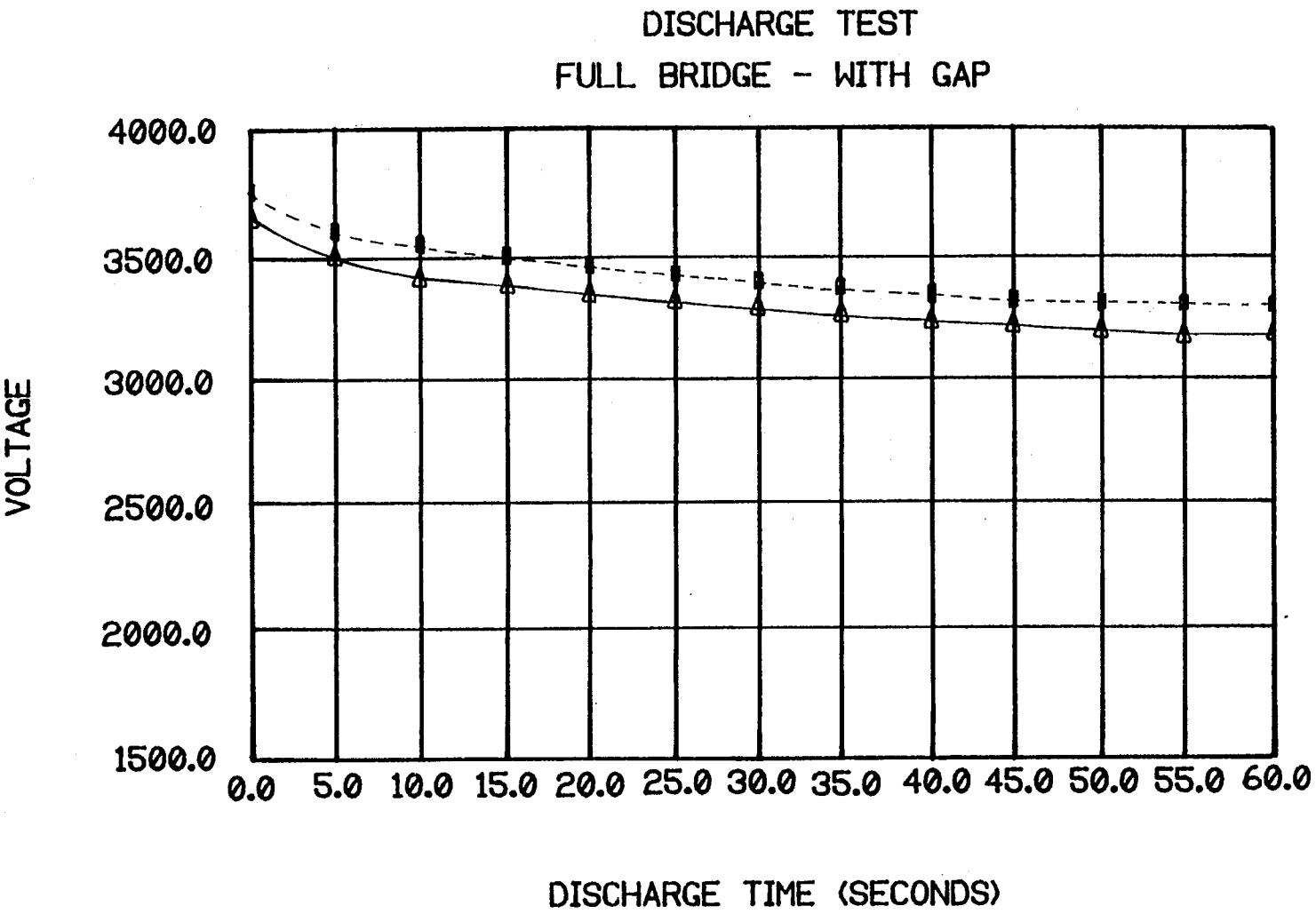
Figure 17:
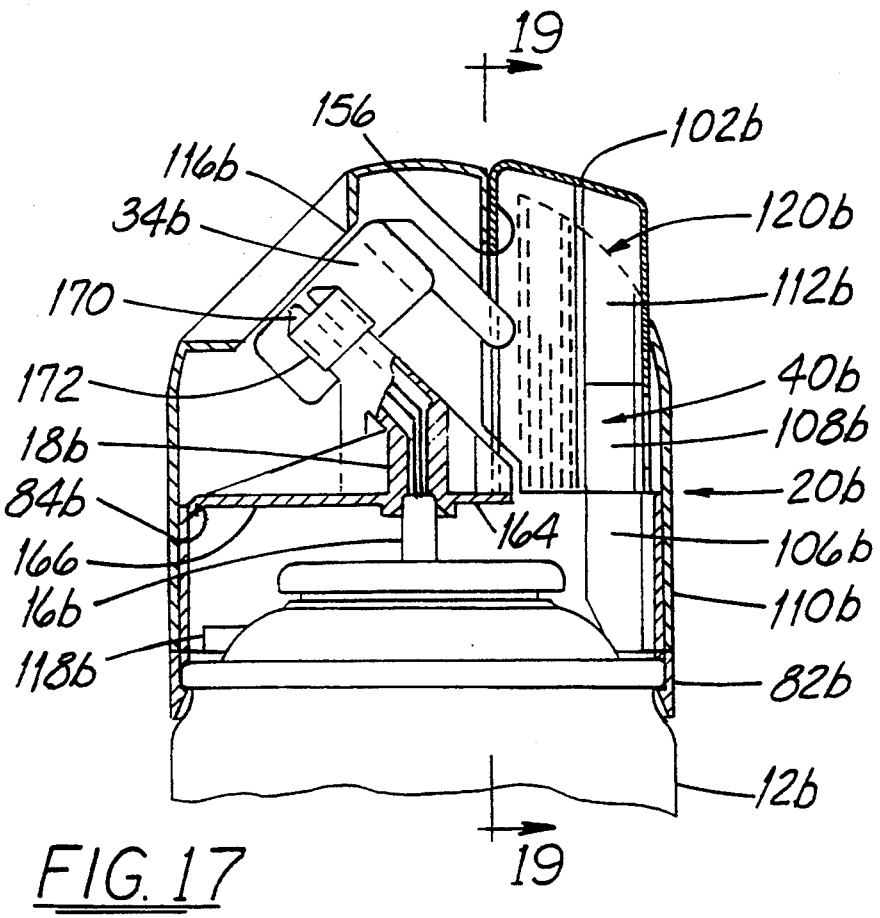
Figure 20:
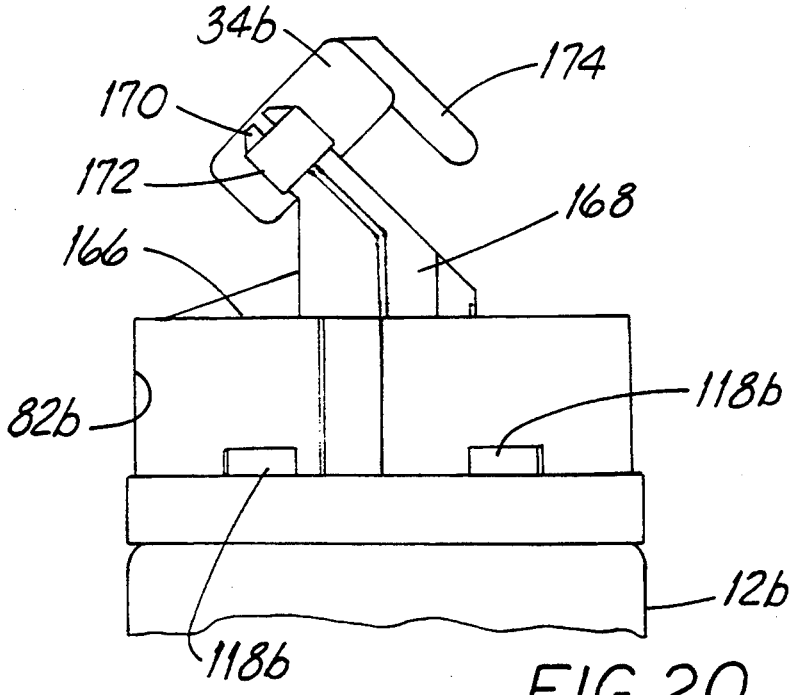
Figure 18:
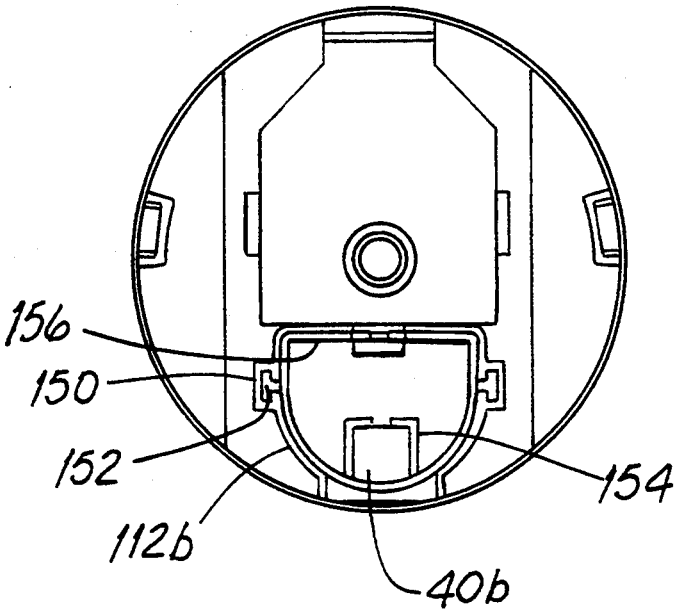
Figure 19:
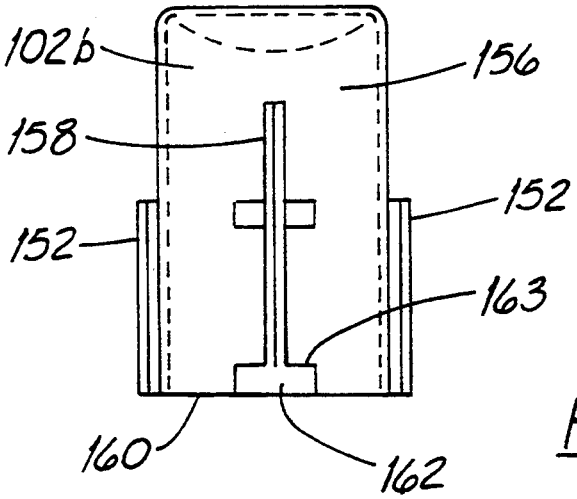
Figure 21A:
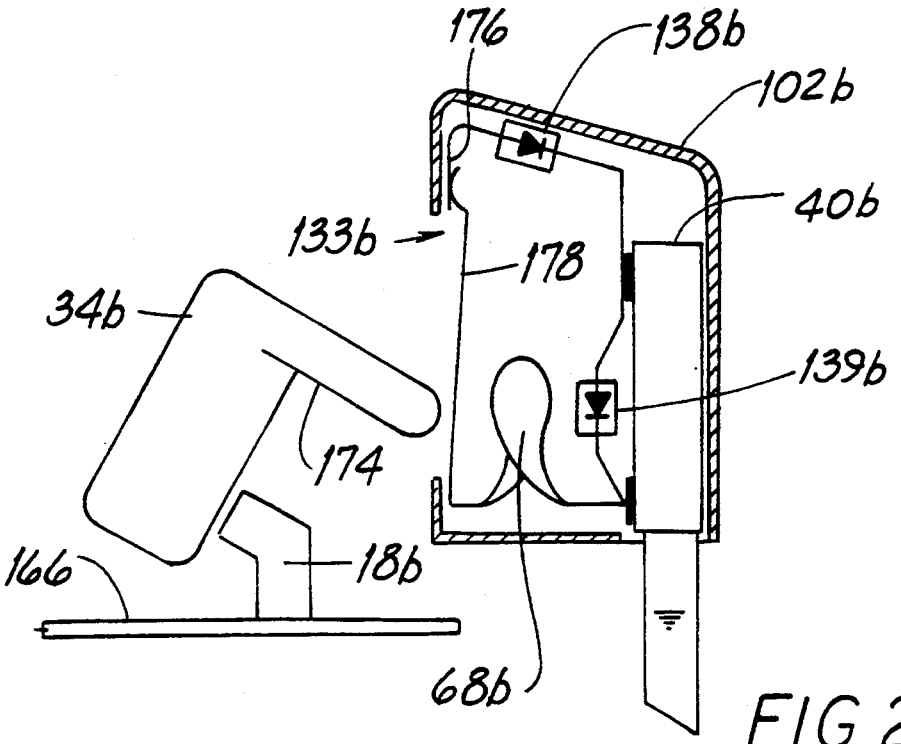
Figure 21B:
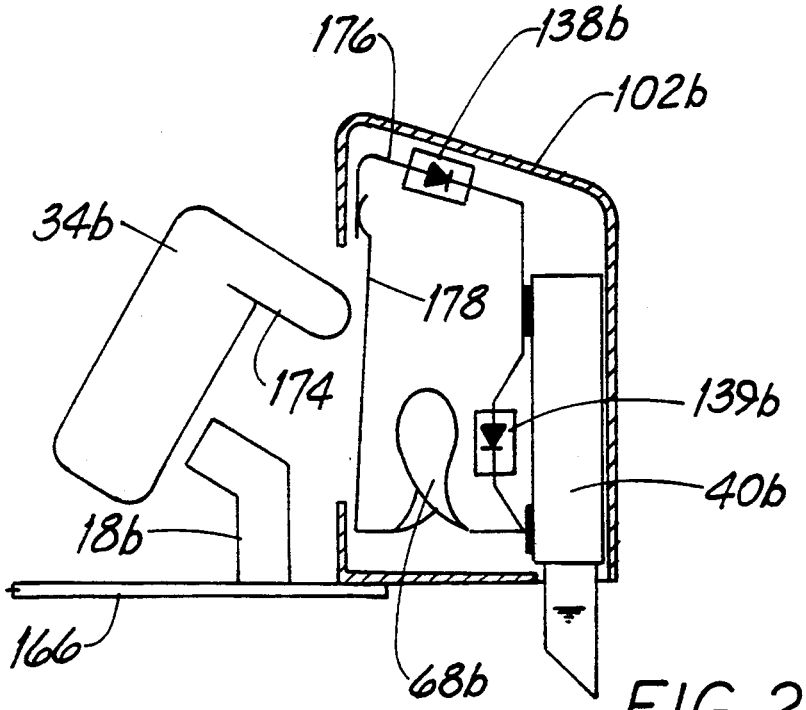
Figure 21C:
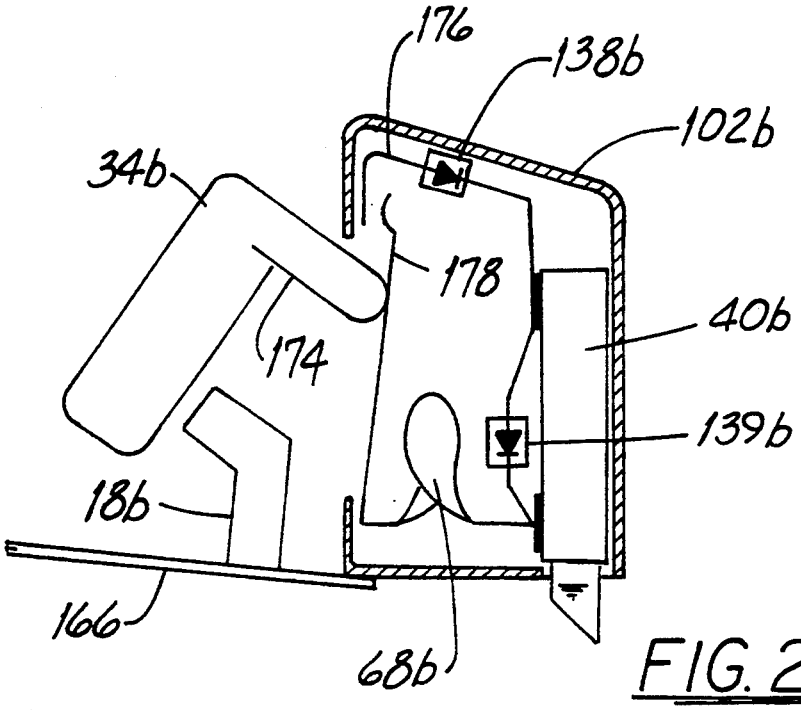
Figure 22A:
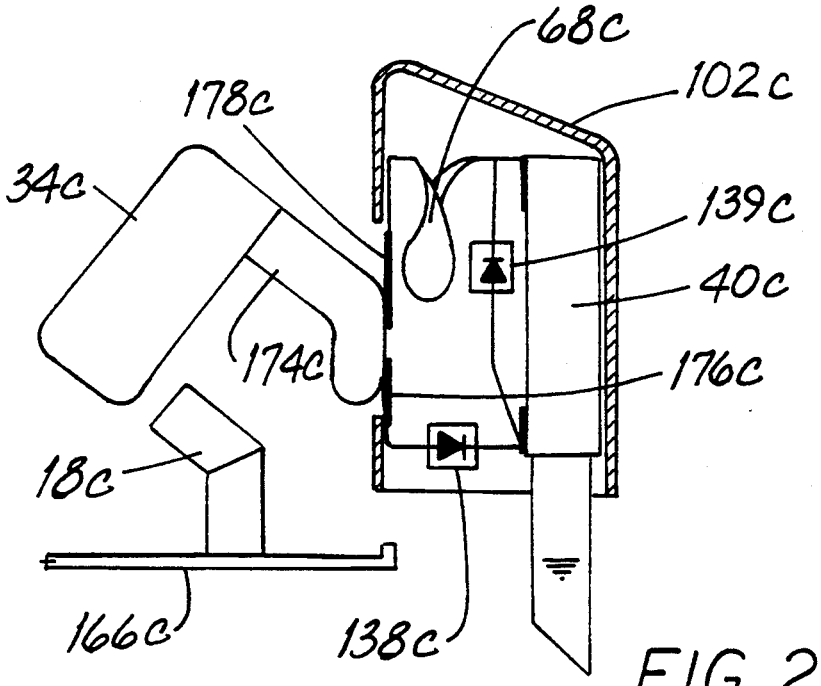
Figure 22B:
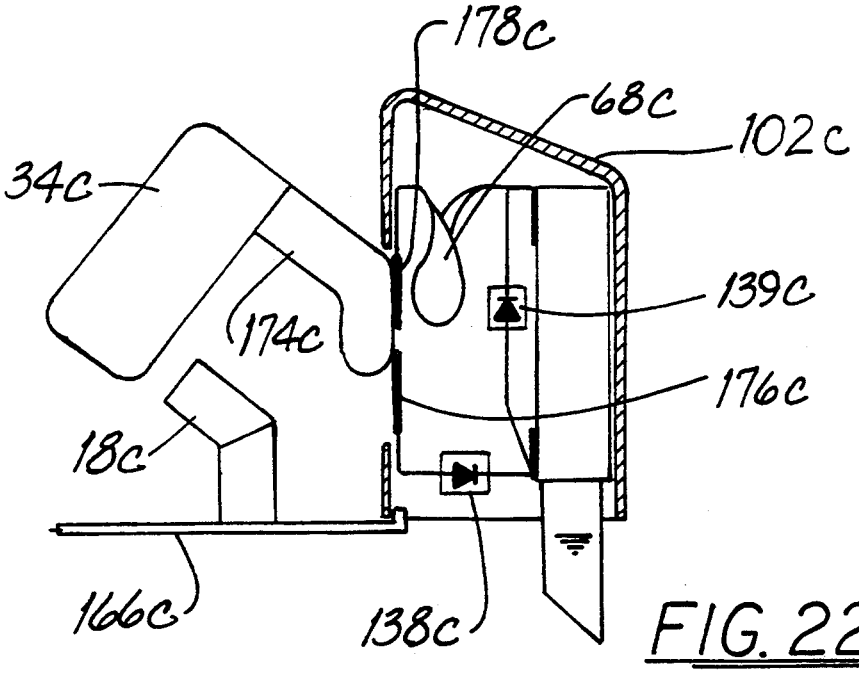
Figure 22C:
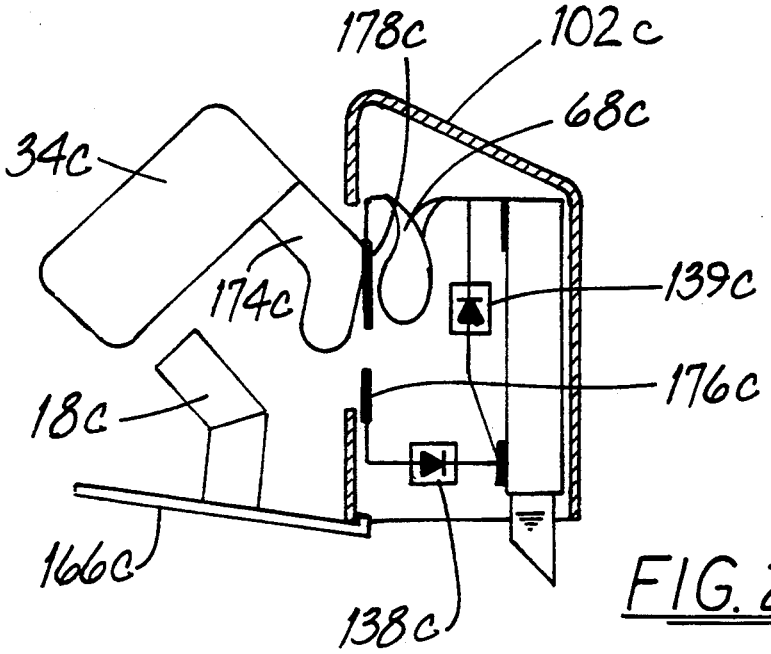
Figure 23:
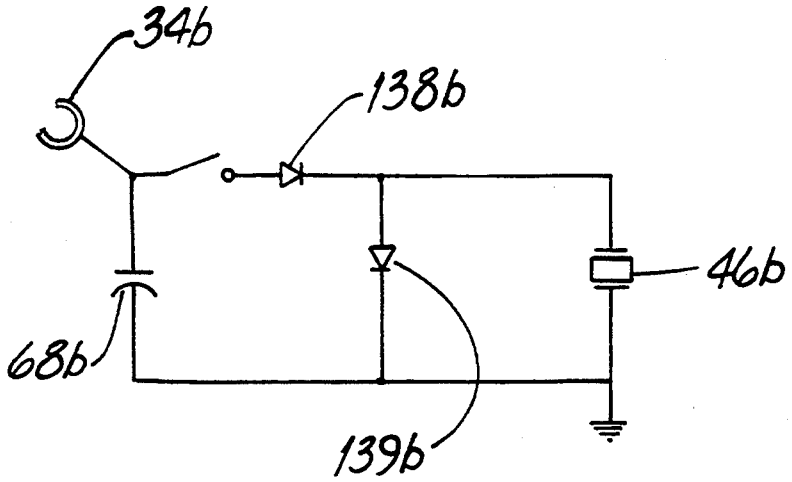

FIGS. 10*a–c* are a series of views showing the arrangement of and sequence of operation of the switch shown in FIG. 9;

FIG. 11 is a circuit diagram of the electrical circuit shown in FIG. 9;

FIG. 12 is an alternative circuit to that shown in FIG. 11;

FIG. 13 is a further alternative circuit to that shown in FIG. 11;

FIG. 14 is a curve showing the variation of inductor charge potential with time in the circuit shown in FIG. 11;

FIG. 15 is a curve similar to FIG. 14 but obtained with the circuit of FIG. 12;

FIG. 16 is a curve similar to FIG. 15 but obtained with the circuit of FIG. 13;

FIG. 17 is a side elevation partly in section of a third and preferred embodiment of dispenser and actuator;

FIG. 18 is an underside view of the embodiment shown in FIG. 17;

FIG. 19 is a view on the line 19—19 of FIG. 17;

FIG. 20 is a side view showing further details of the embodiment of FIG. 17;

FIGS. 21*a–c* show a schematic representation of the arrangement of the electrical circuit during different stages of operation used in the embodiment of FIG. 17 with sequential stages of operation being denoted as FIGS. 21*a*, 21*b* and 21*c* respectively;

FIGS. 22*a–c* show a schematic representation similar to FIG. 20 of an alternative arrangement of switch with sequential stages of operation being denoted as FIGS. 22*a*, 22*b* and 22*c* respectively; and FIG. 23 is a circuit diagram of the electrical circuit used in FIG. 17.

Figure 1:
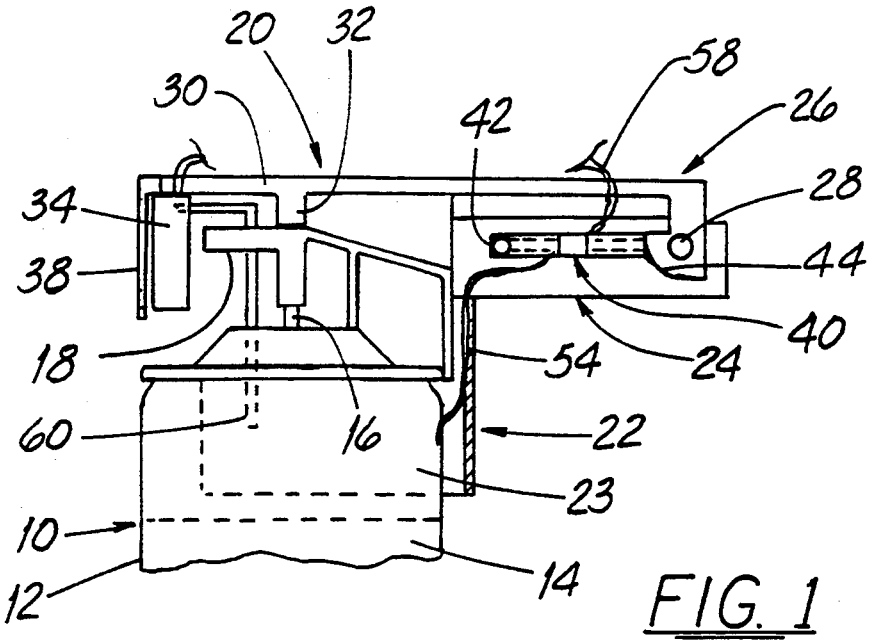

Referring therefore to the drawings and in particular to FIG. 1, a dispenser 10 includes a container 12 which stores a fluid 14 under pressure. Fluid is released from the container 12 by a valve 16 and dispensed through a nozzle 18 as an atomized spray. The fluid 14 may be a suitable mixture of carrier and active ingredient as is conventionally dispensed from an aerosol and the fluid should be electrically conductive at least at the point of atomization. Moreover, an electrically conducting path must be provided from the atomized fluid to a body of relatively large capacitance. Typically, the fluid will be conductive and the body of fluid in the container will provide the necessary capacitance. If the fluid is not conductive, then a connection must be made from the fluid to ground or to the operator. Where the fluid is conductive, the nozzle 18 is preferably non-conductive to increase the electrical path length between the container and the inductor. If the fluid before the nozzle is dielectric, the nozzle 18 and container 12 may be made of conductive material and connected to one another such that an operator will be electrically connected to the atomized fluid and provide the relatively large capacitance body.

The container 12 is conveniently in the form of a conventional aerosol container that is capable of delivering spray rates of between 0.1 gm/s and 3.0 gm/s. The container therefore will not be described in further detail except to note that valve 16 is biased to closed position and opened against the bias by movement along the longitudinal axis of the container.

An actuator 20 is mounted on the container 12 and includes a housing 22 secured to the container 12 by a part circular clip 23 extending around the container 12. The housing 22 includes an arm 24 that extends rearwardly from the container 12 and supports a lever assembly 26 that is pivotally connected to the arm 24 through a pin 28. The lever assembly extends forwardly from the pin 28 to a head 30 which is engageable through a projection 32 with the valve 16. Downward movement of the head 30 moves the valve 16 against its bias to an open position to release the fluid 14 from the container.

Figure 3:
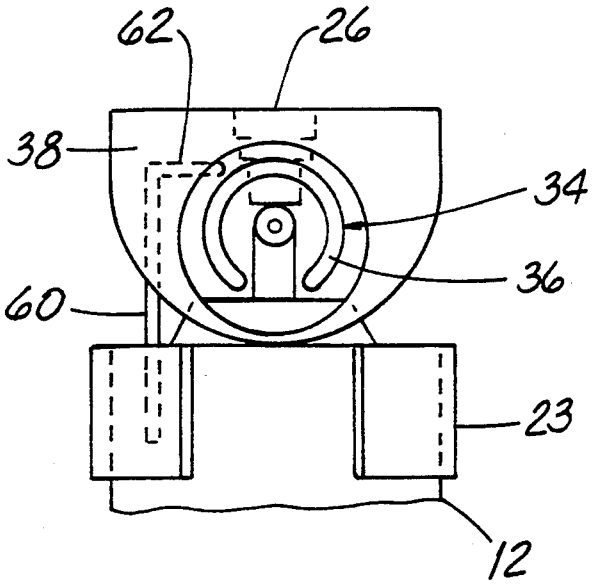
FIG. 3 is an end view of the actuator shown in FIG. 1.

The head 30 carries an inductor 34 that is positioned slightly in advance of the nozzle 18. The head 30 and preferably the lever assembly 26 is formed from an insulating material to isolate electrically the inductor 34 from the container 12. As can best be seen in FIG. 3, the inductor 34 is in the form of a segment of a ring 36 which partially encompasses the nozzle 18. The inductor 34 is positioned relative to the nozzle 18 so as to generate an electrical field at the exit to the nozzle. As fluid is dispensed, it is subjected to the field just prior to atomization so that an electrical continuity is maintained with the fluid 14.

A shield 38 is also attached to the head 30 in advance of the inductor 34 and comprises an annulus of insulating material of larger diameter than the ring 36.

The arm 24 also supports a piezoelectric crystal assembly 40, one end of which is connected by a pin 42 to the arm 24 and the other end of which bears against a cam surface 44 formed on the lever assembly 26.

As can best be seen in FIG. 2, the cam surface 44 includes a first portion of progressively increasing radius smoothly merging with a second portion that is centered on the axis of the pin 28. The piezoelectric crystal assembly 40 includes a crystal 46 located between a pair of anvils 48,50. The anvils 48,50 are slidable within a sleeve 52 with the anvil 48 connected to the pin 42 and the anvil 50 bearing against the cam surface 44. One side of the crystal 46 is electrically connected to the body of the container 12 by means of a ground strap 54 and the other side is connected through an electrical circuit 56 to the inductor 34 by means of a conductor 58.

The housing 22 also supports a grounding electrode 60 which has its lower end in contact with the dispenser 12 and the upper end 62 in a position to engage the ring 36 when the valve 16 is closed. As can be seen in FIG. 4, the circuit 56 includes a charge maintaining branch 66 which is connected to the conductor 58 and is also connected to the body of the container 12 through a capacitor 68.

In operation, the valve 16 is normally closed by a spring bias with the head 30 of the lever assembly 26 in a first position resting on the valve 16. To spray the fluid 14, the head 30 is depressed, causing the lever assembly 26 to pivot about the pin 28. As the lever assembly 26 pivots, contact between the inductor 34 and grounding electrode 60 is broken to isolate electrically the inductor 34. The cam surface 44 forces the anvil 50 toward the anvil 48 and in so doing stresses the crystal 46. An electrical potential is thus generated by the crystal 46 and is maintained as the constant radius cam surface bears against the anvil 50.

The potential generated by the crystal 46 is applied through the conductor 58 to the inductor 34.

Further depression of the head 30 moves it to a second position which opens the valve 16 and causes fluid 14 to be sprayed through the nozzle 18. The fluid passes through the ring 36 where the electric field established by the inductor induces a charge of opposite polarity to that on the ring 36 to the atomized fluid. The spray from the nozzle thus acquires a charge as it is dispensed from the nozzle to enhance its deposition upon the target surface.

The inductor 34 moves with the head 30 so that during spraying the nozzle 18 is centered in the ring 36 to maximize the electric field at the nozzle and minimize wetting of the inductor 34.

The action of the induction charging is such that there is no net current flow from the inductor 34 during spraying. The current flows through the body of the fluid 16 to the nozzle 18 where a charge of opposite polarity is induced on the droplets as they emerge from the nozzle. There will, however, inevitably be a small amount of surface leakages from the ring 36 so that the potential on the ring 36 gradually reduces.

Upon release of the head 30, the valve 16 closes and the lever assembly 26 returns to a position in which the crystal 46 is unstressed and the electrode 60 contacts the ring 36. If there has been any leakage from the inductor 34, the crystal will have a bias of an opposite potential proportional to the leakage from the inductor 34. This is neutralized by flow through conductor 58 and electrode 60 to ground so that the full potential is established on the inductor at the next actuation of the valve 16.

The use of induction charging permits a piezoelectric crystal assembly to be used to generate the electrical charge on the inductor which avoids the use of external batteries or other power sources. As such, the device is economical to produce and suitable for use with standard aerosol devices. Because induction charging is utilized to induce a charge on the atomized fluid, the power requirements are small. With adequate insulation of the inductor the potential may be maintained on the inductor for an extended period.

An alternative embodiment is illustrated in FIGS. 5 through 11, which shows an actuator that may be incorporated into a standard overcap of an aerosol dispenser. Like reference numerals will be used to denote similar components that are illustrated in the embodiment of FIGS. 1 through 4, with the reference numeral "a" added for clarity.

Referring therefore to FIGS. 5–8, a dispenser **10*a* includes a container 12*a* with a valve 16*a* to dispense the fluid 14*a* from the container 12*a*. A nozzle 18*a* is connected to the outlet of the valve 16*a* to dispense an atomized spray of the fluid 14*a*. The nozzle 18*a* is integrally moulded with the actuator 20*a* and is connected to an inner peripheral wall 80 of a cap 82 by a living hinge 84. The cap 82 is secured to the container 12*a* by a snap fit. The inner peripheral wall 80 and an outer peripheral wall 86 on the cap 82 engage with respective ribs 88,90 formed on dome 91 of the container 12*a* with an interference fit that retains the cap 82 on the dome 91. The inner wall 80 terminates adjacent the nozzle 18***a* to allow fluid to flow out of the nozzle 18*a* and leave it relatively unencumbered.

A cruciform support 92 is attached to the nozzle 18*a* and has a forwardly-projecting limb 94 that carries an inductor 34*a* at the distal end. The inductor 34*a* is periannular, that is, in the form of a part ring, so as to encompass partially the nozzle 18*a*. The support 92 also has a pair of transverse arms 96,98 that carry circuit elements of the electrical circuit 56*a* as will be described more fully below. An abutment surface 100 is formed on the support 92 rearwardly of the arms 96,98 and is engaged by an operating button 102. The support 92 and preferably the cap 82 is made from electrically insulating material to isolate the inductor 34*a*.

Figure 8:
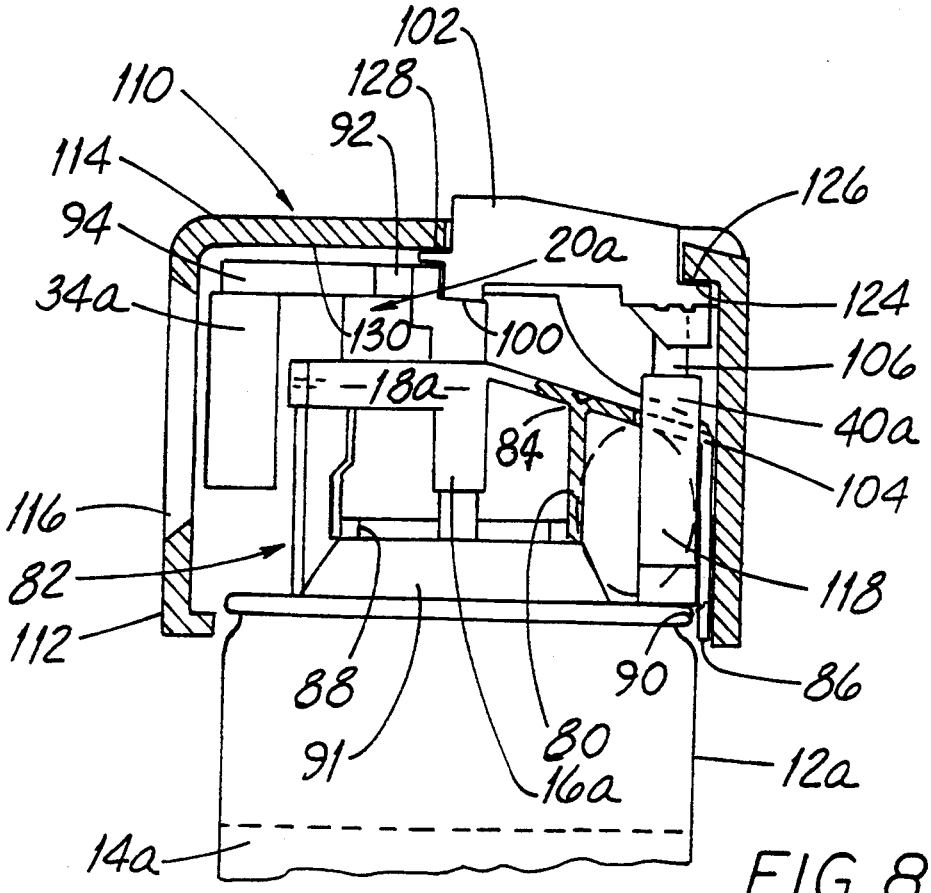
FIG. 8 is a side elevation, partly in section, of a second embodiment of actuator.

As seen more clearly in FIG. 8, button 102 extends between the abutment surface 100 and a piezoelectric crystal assembly 40*a* that is supported within a slot 104 formed within the inner peripheral wall 80. The crystal assembly 40*a* includes a pair of telescopic body portions 106,108 that house a striker assembly designed to impart a transient force to a piezoelectric crystal located within the telescopic body. The crystal assembly 40*a* is a commercially available unit such as that available from Matsushita under their Part No. MI25. As such, the details of the assembly 40*a* need not be described further except to note that the body portions 106,108 are biased away from one another by a resilient spring to re-arm the striker assembly as the body portions 106,108 move to their extended position. The crystal assembly 40*a* may be of any appropriate commercially available unit and preferably will be selected to provide a charge on the inductor 34*a* in the order of 200 to 5,000 volts. When utilized with the aerosol, it is preferred that a charge in the range of 0.1 to 15 μColombs/gm. of fluid dispensed would be induced on the atomized fluid. The terminal 54*a* of the crystal assembly is formed at its lower end and a wire 58*a* extends to the circuit 56*a*.

The button 102 is constrained for a sliding motion within a cover assembly 110. The cover assembly 110 includes a peripheral skirt 112 that extends about the outer wall 86 and an end wall 114 that extends across and is spaced from the support 92. An aperture 116 is formed in the skirt 112 in general alignment with the inductor 34*a* to permit egress of spray from the nozzle 18*a*. A pair of vent apertures 118 are formed on the opposite side of the skirt 112 to the aperture 116 to allow air to flow through the cover to the area of the nozzle 18*a*. Corresponding apertures are formed in the outer wall 86 of cap 82 so that air flows alongside the inner peripheral wall 80 and along the nozzle 18*a*.

The button 102 is located within a slot 120 formed in the end wall 114 and is constrained from movement along the longitudinal axis of the container 12*a* by a pair of vertical flanks 122. Movement of the button 102 out of the cover 110 is inhibited by a rearwardly extending ledge 124 formed on the rear edge of the button 102 which engages an inwardly-directed shoulder 126 formed on the skirt 112 and by a forwardly-projecting flange 128 that engages with the underside 130 of the end wall 114. The button 102 is thus free to slide along the longitudinal axis to telescope the crystal assembly 40*a* and actuate the valve 16*a*.

As noted above, the lower end of the crystal assembly 40*a* is in contact with the dome 91 of the container 12*a*. Where the container 12*a* is formed from an electrically conductive material, then this contact also serves to electrically connect one end of the crystal within the assembly 40*a* with the container 12*a* and with the contents 14*a*. If the container is non-conductive, then a ground strap must be provided to extend into contact with the contents 14*a*.

The opposite end of the crystal is electrically connected by a wire 58*a* to a terminal 134 supported on the upper surface of the cap 82. The terminal 134 is part of a switch 133, is formed as a leaf spring to be resilient and is biased into contact with a terminal 136 carried at one end of the arm 96 and electrically connected to the electrical circuit 56*a*. The terminal 134 is also engageable with a grounding electrode 60*a* carried on the underside 130 of the cover 110 but in its free body state is spaced from the electrode 60*a*. While FIG. 9 shows the grounding of both the inductor and crystal assembly through terminal 60*a*, it will be appreciated that the diode 139 would alone be adequate to eliminate any residual bias on the piezoelectric crystal that may have arisen from charge loss from the inductor.

The electrical circuit 56*a* is physically located in the cruciform support 92 as shown in FIG. 9 and is shown schematically in FIG. 11. Circuit 56*a* includes a charge-maintaining diode 138 that is connected between the terminal 136 and the inductor 34*a* by a wire 140. A capacitor 68*a* is carried at the distal end of the arm 98 and is connected to the container through a ground strap 54*a*. The terminal 134 is also connected to the container 12*a* through a rectifying diode 139 and a second ground strap 54*a*.

The switch 133 is operable to control the connection of the crystal assembly 40*a* to the inductor 34*a* as shown in FIG. 10. In the position shown in FIG. 10*a*, the valve is closed and the button 102 released. The terminal 134 is connected to both the ground electrode 60*a* and the circuit terminal 136. This ensures that the crystal 46*a* is at a neutral potential and any electrical bias resulting from leakage of charge from the inductor 34*a* is removed. Upon initial depression of the button 102, the support 92 moves downwardly and as shown in FIG. 10*b*, the terminal 134 moves away from the ground electrode 60*a* due to its resilience and maintains contact with the circuit terminal 136. Continued movement of the button 102 actuates the piezoelectric crystal assembly 40*a* to cause a transient force to strike the crystal 46*a* and generate a high potential charge. This charge is transferred through the circuit terminal 136 to the inductor 34*a* and is maintained by the diode 138. Continued movement of the button 102*a* causes the valve 16*a* to be opened and to dispense the fluid through the nozzle 18*a*. Just prior to opening the valve, the circuit terminal 136 moves out of contact with the terminal 134 (FIG. 10C) so that an air gap is established in the connection between the crystal assembly 40*a* and the inductor 34*a*. This gap is effective to isolate the inductor 34*a* and inhibit leakage current through the diode 138 over an extended period.

The charge is maintained on the inductor 34*a* during spraying and the vents 118 allow air to flow through the cover 110 and cap 82 to maintain a constant air flow over the inductor 34*a*. This air flow inhibits wetting of the inductor 34*a* and thus reduces leakage of the charge from the inductor. The inductor 34*a* moves downwardly with the support 92 so that its alignment with the nozzle 18 is maintained during spraying.

Once spraying is complete, the button 102 is released and the valve 16*a* closes. The crystal assembly 40*a* is also released to extend the telescopic body and re-arm the striker mechanism. The terminal 136 re-engages the terminal 134 and moves it into engagement with the grounding electrode 60*a* to remove any electrical bias from the piezoelectric crystal.

As may be seen from FIG. 14, with the arrangement described above with the circuit of FIG. 11, the charge is maintained on the inductor 34*a* for a significant period with relatively little decay. The results of a plurality of tests, whose limits are indicated by the two curves, indicates that a voltage in excess of 2,500 volts is maintained on the inductor for in excess of 60 seconds which is an adequate time in which to discharge a typical application of fluid from the container. The decay in voltage over this period is attributable to leakage from the inductor to the container 12 over the surfaces leading to it. By way of comparison FIG. 15 shows the decay rate obtained using the electrical circuit of FIG. 12. In this circuit, the switch 133 is similar to that shown in FIG. 4 in that the crystal assembly remains electrically connected to the inductor during spraying. The charge maintaining diode 138 maintains the charge on the inductor but the back current leakage across the diode results in a more rapid decay, although an acceptable high potential is maintained for a significant spraying period. However, it will be noted that the introduction of the air gap between the inductor and the piezoelectric crystal attenuates the rate of discharge.

Again, the piezoelectric crystal assembly 40*a* is self-contained and does not require the use of external batteries. This provides an economical actuator assembly that can be incorporated within the product and improve the efficacy of the dispensing of the contents of the container.

Figure 5:
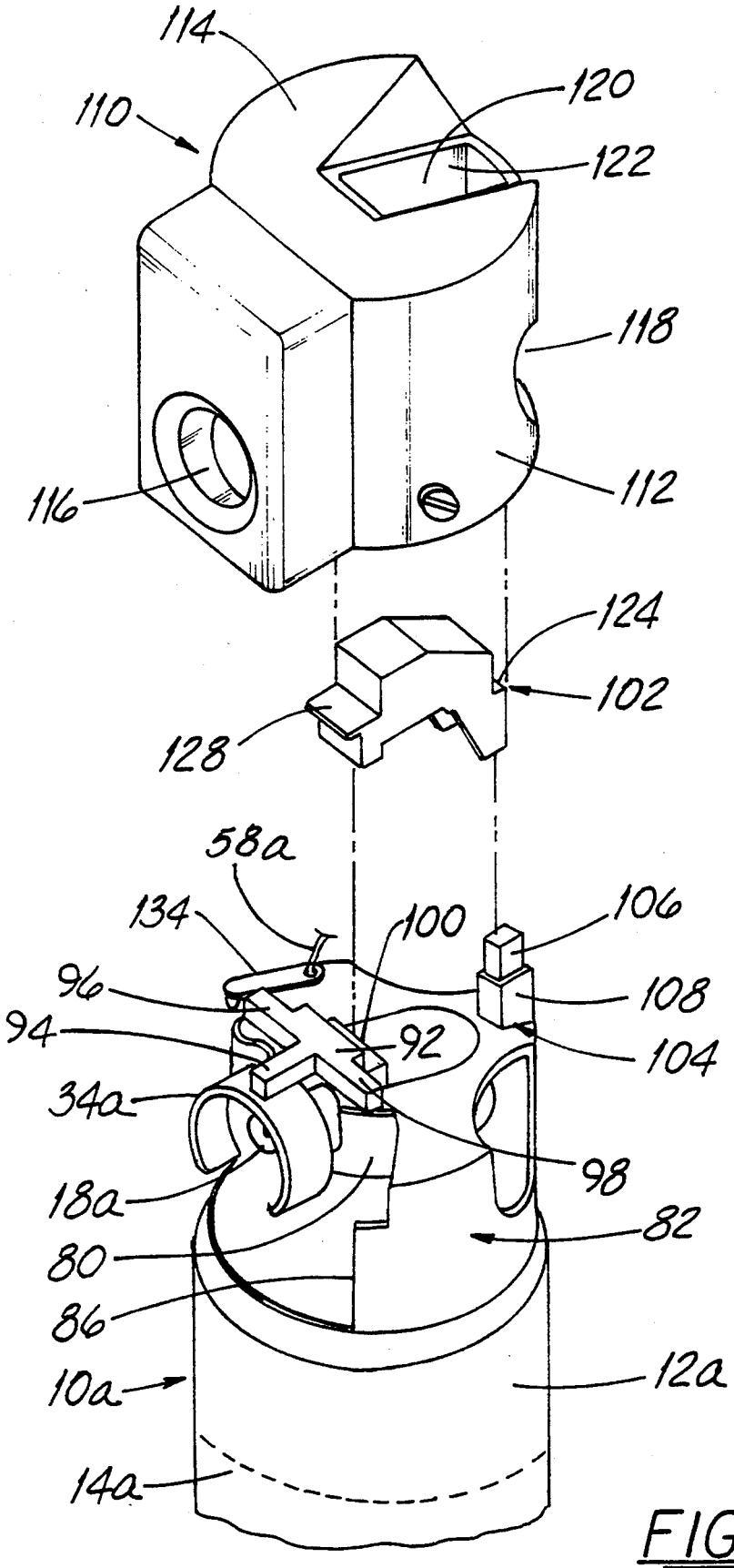
FIG. 5 is an exploded perspective view of a second embodiment of a dispenser and actuator.
Figure 6:
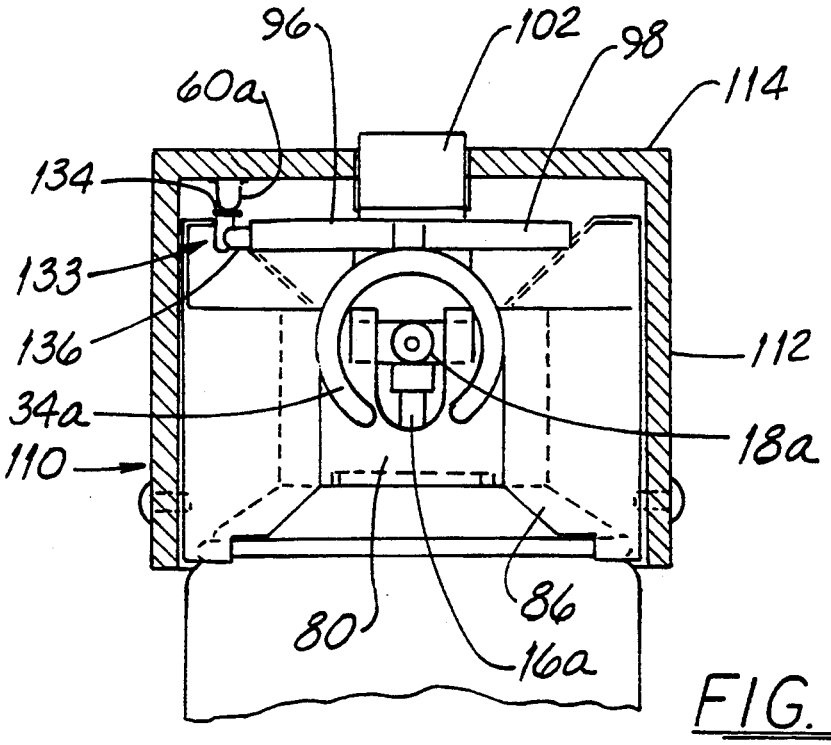
FIG. 6 is a front view partly in section of the embodiment shown in FIG. 5.
Figure 7:
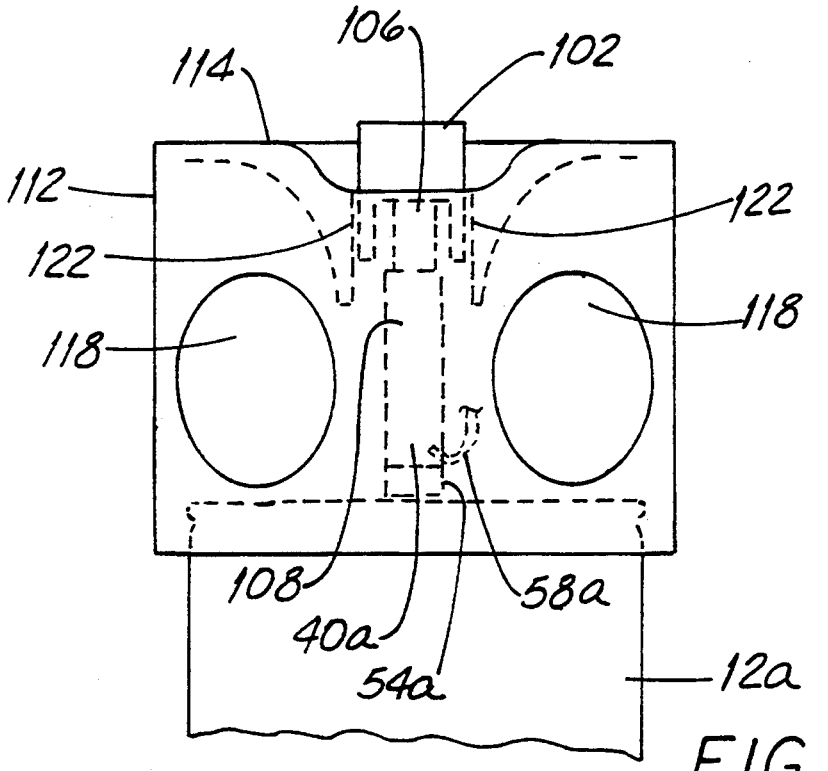
FIG. 7 is a rear view of the embodiment shown in FIG. 5.

Various changes may be envisaged with the embodiment shown in both FIGS. 1 and 5, in particular the use of a full bridge rectifying circuit as illustrated in FIG. 13 may be used. In the full bridge circuit, charge is transferred to the inductor through rectifying diodes 139 during stressing of the piezoelectric crystal assembly and release of that stress. As a result, as shown in FIG. 16 a higher potential is obtained on the inductor 34 although of course additional circuit elements are utilized. Again it will be noted from FIG. 16 that the charge is maintained on the inductor 34*a* over a significant period with relatively little decay.

It is also envisaged that the crystal assembly 40*a* and button 102 may be made removable from the cap 82 so that they may be transferred between different containers. This arrangement would also ensure that the container 12*a* cannot be actuated without the use of a crystal assembly 40*a* and therefore ensure that optimum deposition of the fluid content is obtained.

Such an embodiment is shown in FIGS. 17 to 21 in which components similar to those disclosed in the previous two embodiments will be identified by like reference numerals with a suffix b added for clarity of description. In this embodiment, the button, circuit and crystal assembly are formed as a removable integral module that may be inserted into or removed from the cover.

Referring therefore to FIG. 17, 18 and 19, an actuator 20*b* is mounted on a container 12*b* by a snap-fit between the rim of the container 12*b* and the moulded detent provided on the lower edge of cap 82*b*. Cover assembly 110*b* is generally dome shaped with a slot 120*b* and aperture 116*b* integrally moulded with the cover 110*b*. Four uniformly spaced apertures 118*b* are formed in the lower edge of the cap 82*b* and four corresponding detents in the cover assembly 110*b*. Other shapes of containers or overcaps may be used as appropriate. Other means of connecting cap 82*b* and cover assembly 110*b* may be used as is convenient and conventional in the art.

The slot 120*b* includes flanks 112*b* with vertically extending re-entrant channels 150. The channels 150 receive a T-shaped projection 152 formed on the outer periphery of a button 102*b*. The channel 150 and projection 152 cooperate to provide a sliding motion of the button 102*b* relative to the cover 120*b* along the axis of the container 12*b*.

A tubular housing 154 is formed within the button 102*b* to receive the piezoelectric crystal assembly 40*b*. The lower end of crystal assembly 40*b* projects downwardly and engages the dome 91*b* of the container 12*b* so that vertically downward movement of the button 102*b* causes telescopic movement of two portions 106*b*, 108*b* of the piezoelectric crystal assembly 40*b*.

As can best be seen in FIG. 19, the front wall 156 of the button 102*b* has an elongate slot 158 extending from the lower edge 160. The lower end of the slot 158 terminates in a wider throat 162 with an inner edge 163 and which receives a rearwardly extending tongue 164 integrally moulded with a platform 166 (FIG. 17). The platform 166 is pivotally connected at its forward edge to the cap 82*b* through the living hinge 84*b*. The platform 166 carries a nozzle assembly 18*b* which is positioned over the valve 16*b*.

The platform 166 has a pair of upstanding flanks 168 located to either side of the nozzle 18*b*. The upper end of flanks 168 are moulded with forwardly inclined prongs 170 that are received within loops 172 formed on diametrically opposite sides of the inductor 34*b*. The inductor 34*b* is thus carried by the platform 166 and moves with it to maintain alignment between the nozzle 18*b* and the inductor 34*b*.

The platform 166, nozzle 18*b* and flanks 168 are preferably integrally moulded from a non conductive plastics material to maintain the electrical isolation of the inductor 34*b* and container 12*b*.

The inductor 34*b* includes a rearwardly projecting finger 174 that extends into the slot 158 formed in the button 102*b*. Finger 174 is conductive and conveniently made of same material as inductor 34*b*. The button 102*b* provides a cavity to accommodate the electric circuit components 56*b* as shown more fully in FIG. 21.

Referring therefore to FIG. 21, the switch 133*b* is formed between a pair of contact strips 176, 178 which are biased toward one another to a closed position. The contact strip 176 is connected through the charge maintaining diode 138*b* to one terminal of the crystal assembly 40*b*. The contact strip 178 is connected through the capacitor 68*b* to the other terminal of the piezoelectric crystal assembly 40*b*. The rectifying diode 139*b* is also connected with the capacitor 68*b* and to the container through the crystal assembly 40*b*.

It will be noted that the button 102*b* can be formed as an unitary module with the circuit 56*b* and the crystal assembly 40*b*. The module can be inserted into the cover assembly 110*b* by sliding the projections 152 into the channels 150. As the module is inserted, the finger 174 enters the slot 158 until the lower portion 108*b* of the crystal assembly 40*b* engages the dome 90*b*. In this position, the tail 166 is located in the throat 162 but is spaced from its upper edge 163 in a vertical direction.

To operate the actuator 20*b*, the button 102*b* is depressed vertically from the position shown in FIG. 21(*a*) to that shown in FIG. 21(*b*) which fires the piezoelectric crystal assembly 40b and transfers a charge through the contact strips 176, 178 to the capacitator 68b. The inductor ring is spaced from the contact 178 so that no charge is transferred to it. At this time, the upper edge of the throat 162 abuts the tail 166 so that continued downward motion to the position shown in FIG. 21(*c*) of the button 102b causes pivoting of the platform 166 about the living hinge 84b. The pivotal movement causes the valve 16b to be opened and discharge the contents of container 12b through the nozzle 18b.

At the same time as the valve 16b is opened, the pivoting motion about the living hinge 84b causes a rearward and downward tilting of the finger 174. This causes the rear of the finger 174 to engage the contact strip 178 and transfer charge to the inductor 34b. The contact strip 178 is also moved away from strip 176 as shown in FIG. 20C. So that the switch 113b is thus opened and the inductor 34b is electrically isolated from the crystal assembly 40b. Reverse leakage through the charge maintaining diode 138b is thus avoided.

Upon release of the button 102b, the bias of the valve 16b returns the platform 166 to a horizontal position and the bias of the crystal assembly 40b causes the button 102b to return to a position in which the switch 133b is closed and the crystal assembly 40b is reset for its next firing.

To disable the dispenser and ensure that it is only operated with the unitary charging module, the button 102b can be extracted vertically to disengage the projections 152 from the channels 150. With the button 102b removed, the valve 16b cannot be operated conveniently and so the contents cannot be readily discharged.

The electrical circuit implemented in the embodiment of FIG. 17 is shown in FIG. 23. It will be noted that the piezoelectric crystal is electrically isolated from ground by the rectifying diode 139b during charging. Diode 139b however allows the charge on the piezoelectric crystal 46b to be neutralized after the switch 133b is opened to prevent the crystal acquiring a bias. If preferred, a direct connection between ground and the crystal can be provided in a manner similar to FIG. 5 to neutralize the crystal and discharge the inductor when the operating member 102b is released.

An alternative embodiment to the switch actuating mechanism shown in FIG. 21 is shown in FIG. 22 with a suffix c used for clarity. In the arrangement shown in FIG. 22, the switch 133c is bridged by a conducting surface of the rearwardly extending finger 174c. Initial downward movement of the button 102c simply slides the contact surfaces along the spaced contact strips 176c–178c. Tilting of the platform 166c causes a rocking motion of the finger 174c and causes it to move out of contact with the contact strip 176c. This effectively isolates the charge maintaining diode 138c to inhibit reverse leakage.

In both embodiments, an air gap has been created in the electrical circuit by operation of the button 102b to open the valve 16b.

It will also be appreciated that similar effects may be obtained by arranging movement of the button 102b such that a dielectric material is inserted between the contacts of the switch to isolate the diode 138b although it is believed that for simplicity, ease of manufacture and lack of surface contamination, the air gap is preferred.

The provision of the self-contained unitary module for the circuit and the crystal assembly as noted above inhibits unintentional discharge of the contents and also allows transfer of the module between containers so that each container can be supplied without the crystal assembly and button.

As noted above, the dispenser described in the preferred embodiments provides a simple yet effective device for improving the efficacy of the delivery of the dispensed material. The provision of a charged spray may result in better efficacy of the active ingredient due to its enhanced delivery to the target. Alternatively, the dispenser may be used to obtain the same results as an uncharged spray with less active ingredient.

We claim:

1. An actuator for use with a spray device having a container and a valve including a nozzle to dispense the contents of said container as an atomized spray, said actuator comprising a piezoelectric crystal assembly having a piezoelectric crystal and a force transmitting member to engage said crystal and induce stress therein, an inductor electrically connectable to said piezoelectric crystal assembly by an electrical circuit and adapted to be located adjacent to said nozzle during egress of said contents, and an operating member movable from a first position in which said valve is closed to a second position to engage and open said valve, said operating member being connected to said piezoelectric crystal assembly to induce a stress in said crystal upon movement of said operating member from said first to said second position and thereby transfer an electrical charge through said circuit to said inductor, whereby fluid dispensed by said nozzle passes through an electric field established by said inductor and has an electrical charge induced thereon.

2. An actuator according to claim 1 wherein said inductor is located downstream of said nozzle and extends about said nozzle in spaced relationship thereto.

3. An actuator according to claim 2 wherein said inductor is connected to said operating member for movement therewith between said first position and said second position.

4. An actuator according to claim 3 wherein said operating member includes a support of electrically insulating material and said inductor is connected to said support to isolate electrically the inductor from the container.

5. An actuator according to claim 1 wherein a switch is connected in said electrical circuit between said piezoelectric crystal assembly and said inductor, said switch being operable to disconnect electrically said inductor and said piezoelectric crystal assembly when said operating member is in said second position.

6. An actuator according to claim 5 wherein movement of said operating member from said first to said second position opens said switch.

7. An actuator according to claim 6 wherein movement of said operating member from said first to said second position causes an intermittent stressing of said piezoelectric crystal to produce a transient electrical charge for transfer through said circuit, said circuit including a circuit element interposed between said piezoelectric crystal and said inductor to inhibit charge on said inductor being transferred to said piezoelectric crystal.

8. An actuator according to claim 7 wherein said switch is operable to connect said inductor and said container when said operating member is in said first position.

9. An actuator according to claim 7 wherein said piezoelectric crystal is stressed prior to said operating member engaging and opening said valve.

10. An actuator according to claim 9 wherein said switch is opened as said operating member engages and opens said valve.

11. An actuator according to claim 10 wherein switch is opened by engagement of said inductor with a switch element as said operating member moves to said second position, electrical charge being transferred through said switch element to said inductor during such engagement.

12. An actuator according to claim 2 wherein said operating member maintains said piezoelectric crystal assembly under stress while said operator is in said second position.

13. An actuator according to claim 5 wherein movement of said operating member from said first position causes an intermittent stressing of said crystal in said crystal assembly and a circuit element is interposed between said crystal and said inductor to inhibit the transfer of charge from said inductor to said crystal.

14. An actuator for use with a spray device having a container and a valve including a nozzle to dispense the contents of said container as an atomized spray, said actuator comprising a piezoelectric crystal assembly having a piezoelectric crystal and a force transmitting member to engage said crystal and induce stress therein, an inductor electrically connectable to said piezoelectric crystal assembly by an electrical circuit and adapted to be located adjacent to said nozzle during egress of said contents, and an operating member movable from a first position in which said valve is closed to a second position to engage and open said valve, said operating member being connected to said piezoelectric crystal assembly to cause an intermittent stressing of said crystal upon movement of said operating member from said first to said second position and thereby transfer an electrical charge through said circuit to said inductor, said electrical circuit including a circuit element interposed between said crystal and said inductor to inhibit transfer of charge from said inductor to said crystal assembly, whereby fluid dispensed by said nozzle passes through an electric field established by said inductor and has an electrical charge induced thereon.

15. An actuator according to claim 14 wherein said circuit element is a diode.

16. An actuator according to claim 14 wherein a switch is located between said crystal and said inductor to isolate said inductor from said piezoelectric element, said switch being closed during intermittent stressing of said crystal to connect electrically, said crystal and inductor and open thereafter.

17. An actuator according to claim 16 wherein movement of said operating member from said first position initially conditions said switch to connect said piezoelectric assembly to said inductor and further movement toward said second position opens said switch to isolate said inductor and opens said valve to permit egress of contents of said container.

18. An actuator according to claim 17 wherein said switch connects said crystal to said container when said operating member is in said first position to discharge potential from said crystal.

19. An actuator according to claim 18 wherein said switch connects said inductor to said container when said operating member is in said first position.

20. An actuator according to claim 18 wherein said intermittent stressing of said crystal assembly is obtained by striking crystals in said assembly.

21. An actuator according to claim 14 wherein air passages are provided to direct air past the nozzle and across said inductor.

22. An actuator according to claim 14 wherein said electrical circuit includes a charge storage device to receive charge transferred from said crystal through said circuit element.

23. An actuator according to claim 22 wherein a switch is located in said electrical circuit between said piezoelectric crystal and said charge storage device, said switch being closed during intermittent stressing of said crystal to transfer charge from said crystal to said charge storage device.

24. An actuator according to claim 23 wherein said switch is opened upon movement of said operating member to said second position to disconnect said crystal and said charge storage device.

25. An actuator according to claim 24 wherein said inductor is connected to said charge storage device when said switch is open.

26. An actuator according to claim 25 wherein movement of said operating member to said second position causes movement of said inductor to open said switch.

27. An actuator according to claim 26 wherein said inductor moves to engage a switch element and open said switch.

28. An actuator according to claim 27 wherein engagement of said inductor with said switch element transfers charge from said charge storage device to said inductor.

29. An actuator for use with a spray device having a container and a valve including a nozzle to dispense the contents of said container as an atomized spray, said actuator comprising a piezoelectric crystal assembly having a piezoelectric crystal and a force transmitting member to engage said crystal and induce stress therein, an inductor electrically connectable to said piezoelectric crystal assembly by an electrical circuit and adapted to be located adjacent to said nozzle during egress of said contents, and an operating member movable from a first position in which said valve is closed to a second position to engage and open said valve, said operating member being connected to said piezoelectric crystal assembly to induce a stress in said crystal upon movement of said operating member from said first to said second position and thereby transfer an electrical charge through said circuit to said inductor, whereby fluid dispensed by said nozzle passes through an electric field established by said inductor and has an electrical charge induced thereon, operating member including a manually operated button that is removably mounted in said actuator and said piezoelectric crystal assembly and said electrical circuit being located on said button for removal therewith.

30. An actuator according to claim 29 wherein operating member includes a support of electrically insulating material and said inductor is connected to said support.

31. An actuator according to claim 30 wherein said support is operable upon said valve to move it between open and closed positions.

32. An actuator according to claim 30 wherein said button is engageable with said support to move the valve between said open and closed positions.

33. An actuator according to claim 32 wherein said support carries said nozzle to maintain alignment between said nozzle and inductor during movement of said operating member to said second position.

34. An actuator according to claim 32 wherein said circuit includes a pair of switch elements located in said button said inductor cooperating with said switch elements upon movement of said support to open said valve to open said switch and disconnect said inductor and said piezoelectric crystal.

35. An actuator according to claim 34 wherein said inductor engages one of said switch elements and moves it out of engagement with the other of said switch elements upon movement of said operating member to said second position.

36. An actuator according to claim 35 wherein engagement of said inductor with said switch element transfers charge from said piezoelectric crystal to said inductor.

* * * * *